US010927534B2

(12) United States Patent
Gross et al.

(10) Patent No.: US 10,927,534 B2
(45) Date of Patent: Feb. 23, 2021

(54) BATHTUB OVERFLOW ASSEMBLY

(71) Applicant: Jones Stephens Corp., Moody, AL (US)

(72) Inventors: Lloyd Asher Gross, Radnor, PA (US); Andrew Neil Gross, Lafayette Hill, PA (US); Ronald Charles Link, Jr., Raritan, NJ (US); Gordon Lowell Gross, Plymouth Meeting, PA (US); Anthony Joseph Yanka, Moorestown, NJ (US)

(73) Assignee: Jones Stephens Corp., Moody, AL (US)

( * ) Notice: Subject to any disclaimer, the term of this patent is extended or adjusted under 35 U.S.C. 154(b) by 0 days.

(21) Appl. No.: 16/358,983

(22) Filed: Mar. 20, 2019

(65) Prior Publication Data

US 2020/0299944 A1 Sep. 24, 2020

(51) Int. Cl.
*E03C 1/24* (2006.01)

(52) U.S. Cl.
CPC ..... *E03C 1/24* (2013.01); *E03C 2001/2413* (2013.01)

(58) Field of Classification Search
CPC .... E03C 1/24; E03C 1/244; E03C 2001/2413; E03C 1/232; E03C 1/242
See application file for complete search history.

(56) References Cited

U.S. PATENT DOCUMENTS

| | | | | |
|---|---|---|---|---|
| 5,025,509 | A * | 6/1991 | Holt | E03C 1/24 4/694 |
| 5,123,123 | A | 6/1992 | Hart | |
| 6,192,531 | B1 | 2/2001 | Fritz | |
| 6,289,532 | B1 | 9/2001 | Fritz | |
| 6,295,664 | B2 | 10/2001 | Fritz | |
| 6,823,539 | B1 * | 11/2004 | Bantz | E03C 1/04 4/675 |
| 6,845,528 | B2 * | 1/2005 | Bantz | E03C 1/24 4/295 |
| 8,321,970 | B2 | 12/2012 | Ball | |
| 9,200,436 | B2 | 12/2015 | Ball | |
| 9,663,930 | B2 | 5/2017 | Ball | |

* cited by examiner

*Primary Examiner* — Janie M Loeppke
(74) *Attorney, Agent, or Firm* — Lucas & Mercanti, LLP

(57) ABSTRACT

A bathtub overflow assembly having an overflow elbow exterior to the bathtub's overflow port with an externally threaded cylinder extending axially from the overflow elbow in the direction of the overflow port. The assembly has an overflow elbow retaining structure in the tub comprising a retainer ring having a flange sized to circumscribe the overflow port on the interior of the tub. The retainer ring has a centrally mounted sleeve which extends axially in the direction of the elbow. The sleeve is internally threaded to cooperatively engage the threads on the overflow elbow cylinder and has a length which is sufficient to enable it to overlap the overflow cylinder. An overflow test plug which threadedly mounts to the retainer ring is also disclosed.

14 Claims, 5 Drawing Sheets

BATHTUB OVERFLOW ASSEMBLY

FIELD OF THE INVENTION

The invention relates to overflow assemblies for bathtubs.

BACKGROUND

The waste and overflow system for a bathtub generally includes an overflow pipe with an elbow on the back side of the tub which circumscribes the overflow port in the tub. The overflow elbow is retained in place by screws or by a threaded retainer body which extends through the overflow port from the interior of the tub and engages with cooperative threads on the periphery of the interior of the overflow elbow.

When the overflow assembly is installed the overflow elbow must be aligned with the tub's overflow port and with the retaining structure. Heretofore, this has proven difficult because the structures to be aligned are on opposite sides of the tub wall. In particular, for a retainer body to engage threads in the periphery of the overflow elbow the overflow elbow must be essentially perfectly aligned with the overflow port to achieve thread to thread engagement.

U.S. Pat. Nos. 6,295,664 and 6,836,911 are hereby incorporated by reference to explain the operation and function bathtub overflow systems.

SUMMARY OF THE INVENTION

The present invention is overflow assembly for a bathtub that is easy to install and align around the overflow port in a bathtub. It also enables a leak-proof fluid path from the bathtub to the overflow pipe. This is achieved by providing the interior of the overflow elbow with an externally threaded cylinder which projects axially in the direction of the overflow port. The elbow retaining structure in the tub is ring having a flange sized to circumscribe the overflow port. The retainer ring has a centrally mounted sleeve which extends axially in the direction of the elbow. The sleeve is internally threaded to cooperatively engage the threads on the overflow elbow cylinder. The sleeve has a length which is sufficient to enable it to overlap the overflow cylinder to provide enough engagement of the threads of the cylinder and sleeve to provide the structural strength necessary to hold the overflow assembly together. The diameters of the sleeve and the cylinder are not more one half the diameter of the overflow port with the cylinder's diameter being smaller than that of the sleeve.

The sleeve is attached to the retainer ring by at least three, and preferably four, radially extending vanes. The retainer ring, the sleeve and the vanes define therebetween flow paths which extend from the bathtub to the overflow elbow. Engagement of the threads of the overflow elbow cylinder and the sleeve and rotation of the retainer ring pulls the overflow elbow and the retainer ring together with the overflow port to the tub therebetween. Because the elbow cylinder and the sleeve are not more than one half the diameter of the overflow port the alignment of the overflow elbow with the overflow port during initial installation isn't critical. It is only necessary that the overflow cylinder be within opening defined by the overflow port so that it can be seen from within the tub to align the retaining ring sleeve with it. Once the overflow cylinder and the retainer ring sleeve are threadedly engaged the position of the elbow can be manipulated from within the bathtub by moving the retaining ring.

In a preferred embodiment of the invention, the vanes on the ring sleeve extend axially from the retainer ring along at least a portion of the length of the sleeve and are tapered so that a circular surface circumscribing the vanes defines a truncated cone with a diameter which is slightly smaller than the diameter of the overflow port proximate to the retainer ring and approximately the outside diameter of the sleeve at greatest axial projection of the vanes. The overflow assembly is installed by rotating the retainer ring to engage the threads of the sleeve and the threads of cylinder and thereby pull the overflow elbow and the retaining ring together. The tapered vanes on the sleeve slidingly engage the mouth of the overflow port and center the overflow assembly within the overflow port. Preferably, the vanes have an axially vertical shoulder at their point of attachment to the retainer ring. The length of the shoulder is approximately the thickness of a bathtub at position of the overflow port.

Optionally a first annular sealing gasket is positioned between an elbow flange on the periphery to the overflow elbow and the exterior side to the tub overflow port and a second annular sealing gasket is positioned between the interior of the tub overflow port and a retainer ring flange on the periphery of the retainer ring to enhance the fluid tight seal between those components and the tub.

The tub interior side of the ring sleeve can optionally be equipped with an axially aligned internally threaded center bore and a removable test plug having an externally threaded axial projection cooperatively aligned and threadedly engageable with the threads of the center bore. The test plug has a first face sized and adapted to sealing cover the flow paths through the retainer ring when the test plug is mounted on the retaining ring by engaging the axial projection on the plug with the center bore on the ring sleeve and rotating the test plug in a thread engaging direction. Preferably an annular sealing gasket in mounted on the test plug to facilitate a fluid tight seal between the test plug and retainer ring.

In another embodiment of the invention, the test plug has a second face opposite to its test plug face with posts engageable with recesses in the retainer ring. In this embodiment of the invention, the posts on the opposite face of the retainer plug are inserted into the recesses in the retainer ring and test plug used as a wrench to rotate the retainer ring and thereby engage the threads of the elbow cylinder and the retainer sleeve.

In yet another embodiment of the invention, a retainer ring cover is frictionally engageable to the retainer ring to provide the overflow assembly with a finished appearance. The retainer ring cover has one or more flow port to permit water from the bathtub to pass through the retainer ring cover and into the retainer ring flow paths and from there the overflow pipe.

DETAILED DESCRIPTION

Figure 1:
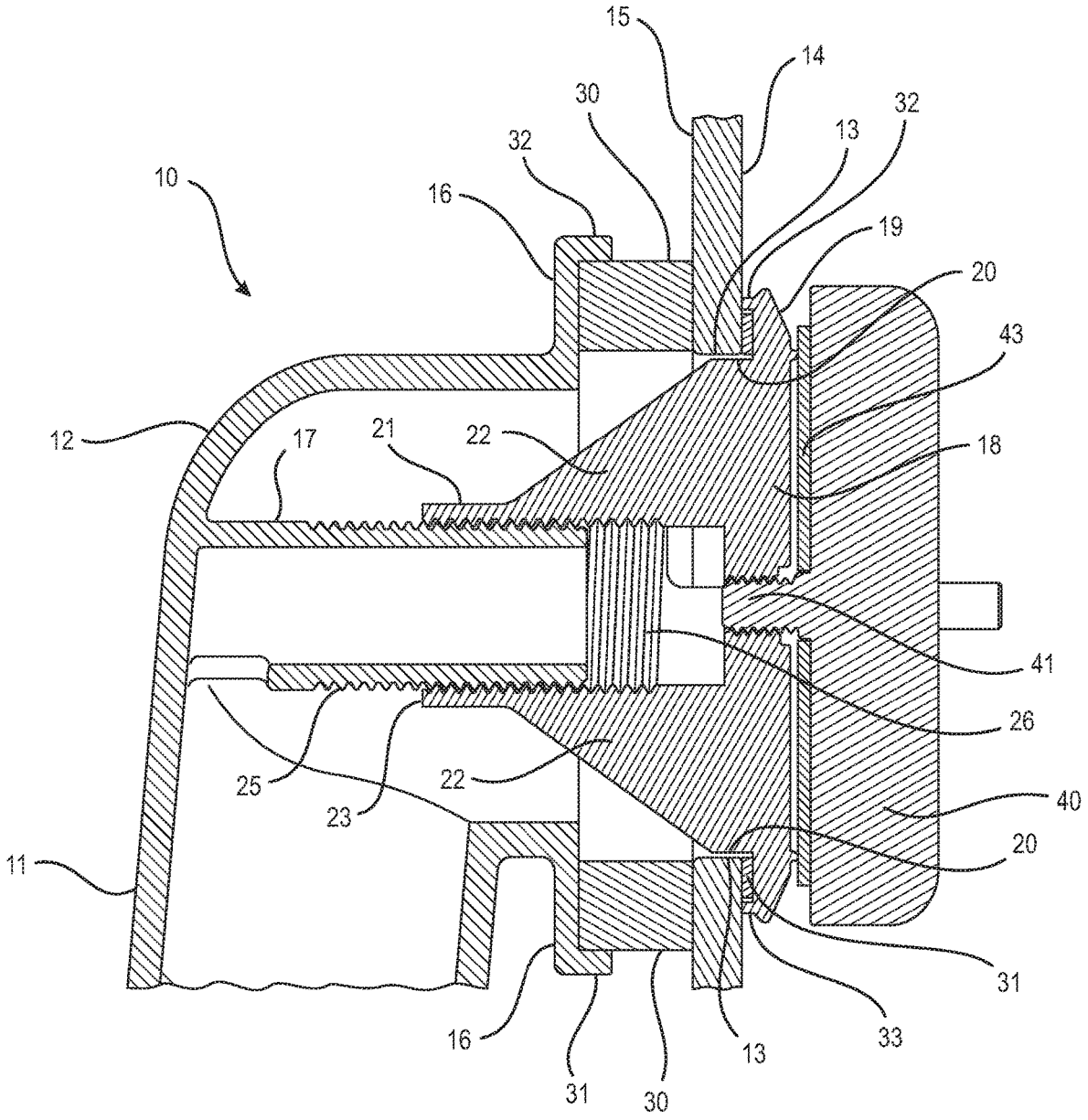
FIG. 1 is a cross-sectional elevation view of a preferred embodiment of the bathtub overflow assembly of the invention with a removable test plug mounted thereon.

The bathtub overflow assembly 10 of the invention is shown schematically in FIG. 1. Assembly 10 includes overflow pipe 11 having overflow elbow portion 12. Overflow assembly 10 is configured for interconnection with a bathtub (not shown) having a circular overflow port 13 of a standard diameter in a wall of the bathtub. Bathtub overflow port 13 has tub interior side 14 and a tub exterior side 15. Overflow pipe 11 has flange 16 sized to circumscribe overflow port 13 on tub exterior side 15. Overflow elbow 12 is axially behind overflow flange 16. Externally threaded cylinder 17 projects axially from overflow elbow 12 in the direction of overflow flange 16. Overflow retainer ring 18 has ring flange 19 sized to circumscribe overflow port 13 on tub interior side 14.

Figure 2:
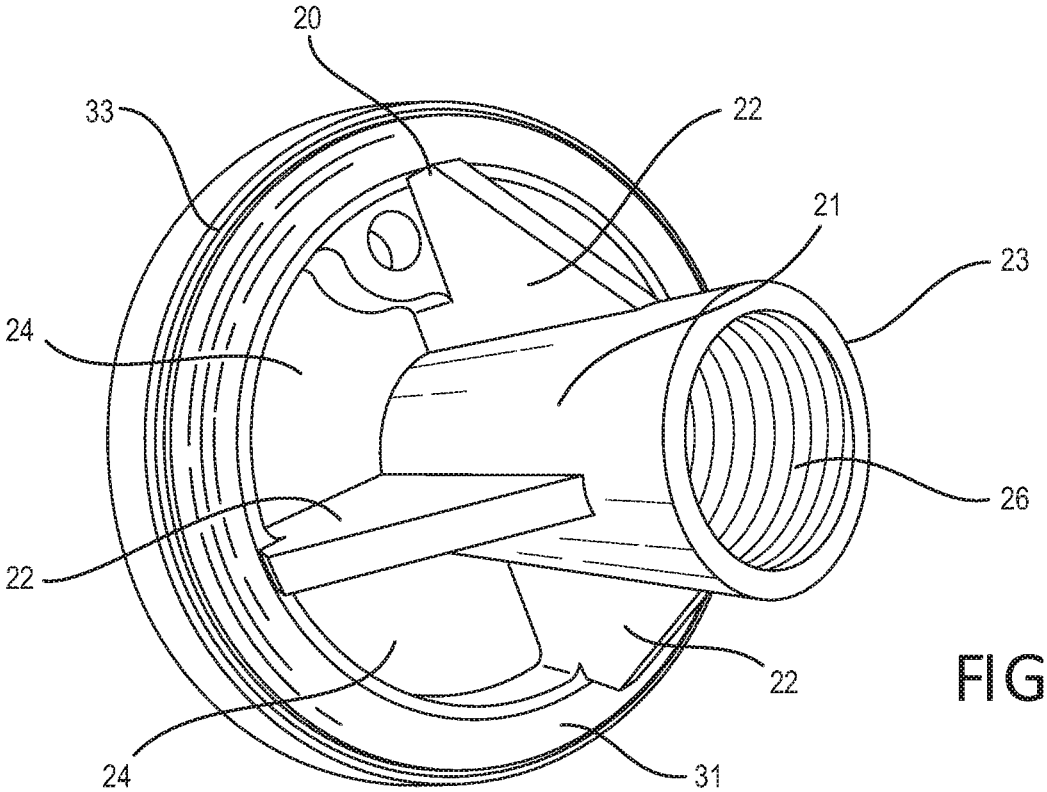
FIG. 2 is a perspective view of the retainer ring of the invention with a sealing gasket mounted thereon.
Figure 3:
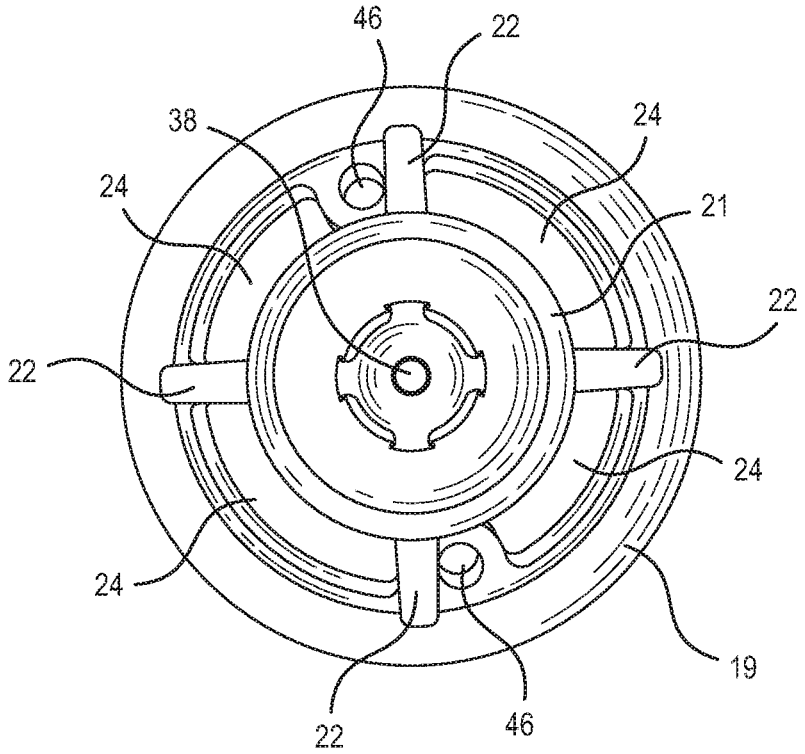
FIG. 3 is a bottom plan view of the retainer ring of FIG. 4 without the sealing gasket.
Figure 4:
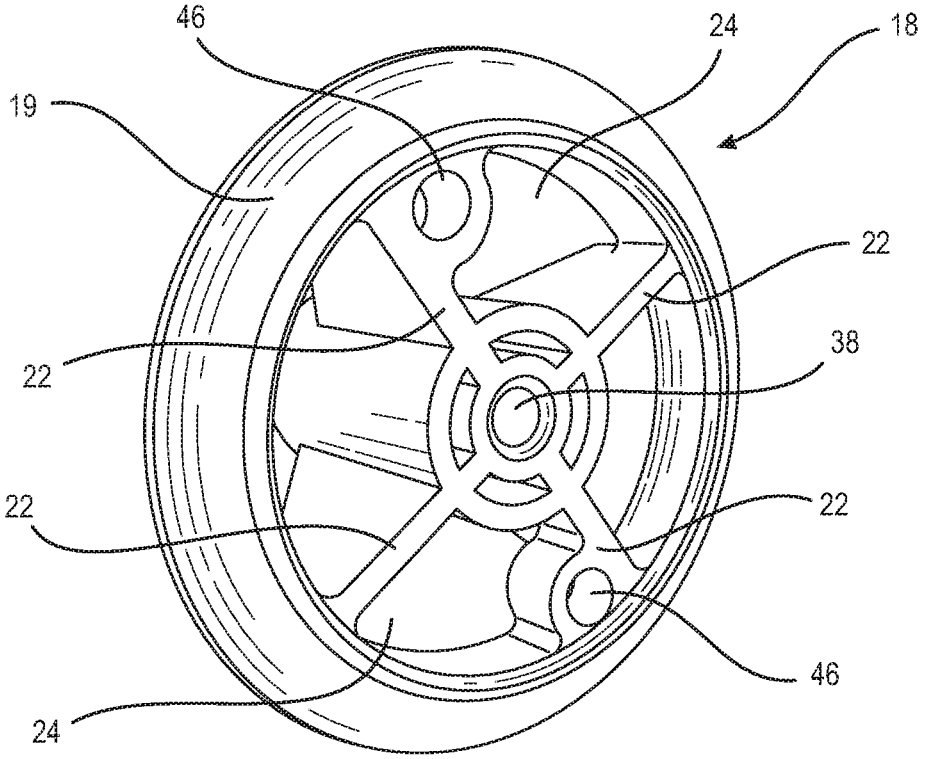
FIG. 4 is a top perspective view of the retainer ring of FIG. 3.

Retainer ring 18 has internally threaded sleeve 21. The outside diameter of sleeve 21 is preferably not greater than one half the diameter of overflow port 13, and more preferably not more than forty percent of the diameter of overflow port 13. Sleeve 21 projects axially from retainer ring 18 in the direction of elbow 12. Sleeve 21 is attached to retainer ring 18 by at least three, and preferably four, radially projecting vanes 22. Vanes 22 are approximately equally spaced around sleeve 21. In a preferred embodiment of the invention vanes 22 extend axially from retainer ring 18 to a position at least one third of the distance to sleeve end 23. More preferably vanes 22 extend axially to a position on sleeve 21 which is at least one half of the distance to sleeve end 23. As best shown in FIGS. 2, 3 and 4, retainer ring 18, sleeve 21 and vanes 22 defining therebetween ring flow paths 24 from the bathtub to the overflow pipe 11. In a preferred embodiment of the invention, vanes 22 are tapered so that a circular surface circumscribing vanes 22 defines a truncated cone with a diameter which is slightly smaller than the diameter of overflow port 13 proximate to retainer ring 18 and approximately the outside diameter of sleeve 21 at the greatest axial projection of vanes 22. The tapering of vanes 22 causes the self-centering of overflow assembly 10 during installation by the sliding engagement of vanes 22 along overflow port 13 as overflow elbow 12 and retainer ring 18 are moved towards each other. In a further preferred embodiment of the invention, tapered vanes 22 are connected to retainer ring 18 by shoulder 20, Overflow pipe cylinder 17 and retainer ring sleeve 21 are axially alignable through overflow port 13 and cylinder threads 25 and sleeve threads 26 are engageable. During installation overflow elbow 12 is positioned at overflow port 13 on tub exterior side 15 and retainer ring 18 is positioned at overflow port 13 on tub interior side 14 and cylinder threads 25 and sleeve threads 26 engaged. Retainer ring 18 is then rotated relative to overflow elbow 12 causing threaded surfaces 25 and 26 of cylinder 17 and sleeve 21 to pull overflow flange 16 and ring flange 19 toward each other on opposites sides of the overflow port 13.

Preferably, annular sealing elbow gasket 30 is provided between overflow flange 16 and tub exterior side 15 and annular sealing ring gasket 31 is provided between ring flange 19 and tub interior side 14. In a further preferred embodiment of the invention, overflow flange 16 has overflow flange shoulder 32 at it outer end and ring flange 19 has ring flange shoulder 33 at it outer end to ensure the proper placement of overflow gasket 30 and ring gasket 31. Overflow flange shoulder 32 and ring flange shoulder 33 at least partially circumscribe respectively gasket 30 and gasket 31.

Figure 5:
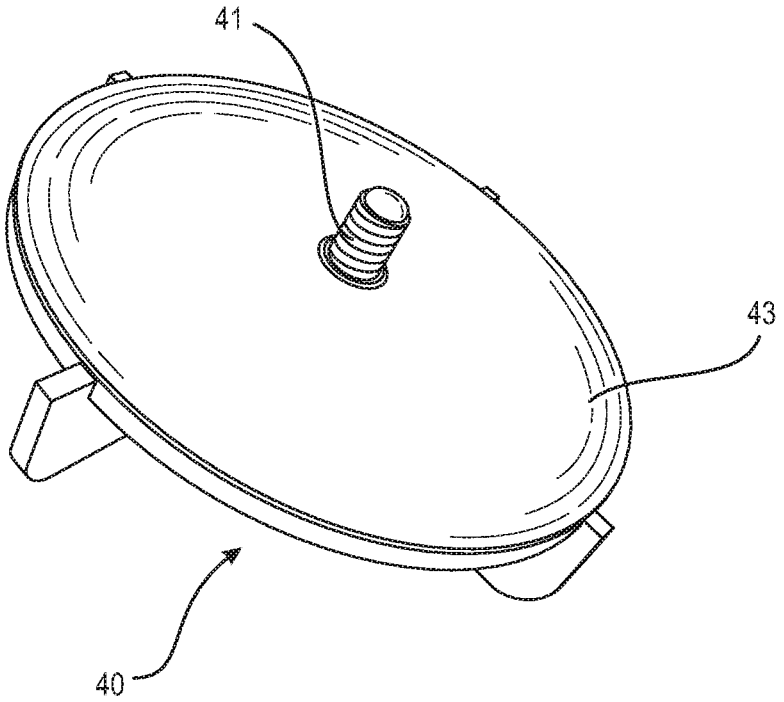
FIG. 5 is a perspective view of the test plug of the invention with a sealing gasket mounted thereon.
Figure 7:
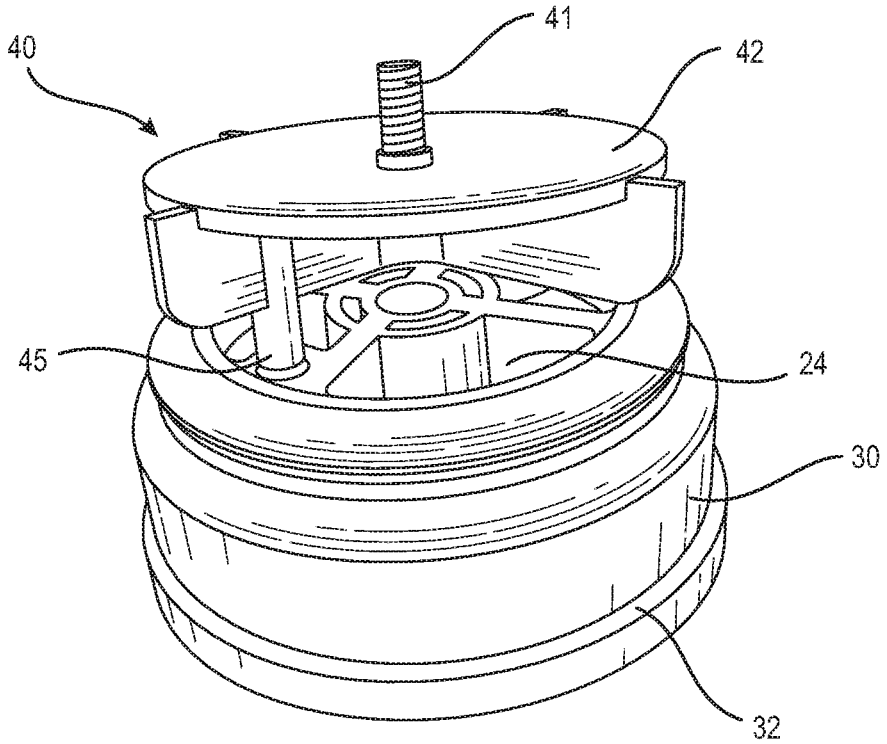
FIG. 7 is a perspective view of the wrench face of the test plug of FIG. 6 partially mounted on the overflow retaining ring of FIG. 4.

As best seen in FIGS. 1 and 4, retainer ring sleeve 21 has axially aligned internally threaded center bore 38. As seen in FIGS. 5 and 7, removable test plug 40 has externally threaded axial center projection 41. The threads of sleeve bore 38 are sized to cooperatively engage the threads of test plug projection 41. Test plug face 42 is sized and adapted to sealingly cover flow paths 24 in retainer ring 18 when test plug 40 is pulled into engagement with retainer ring 18 when plug projection 41 is inserted in sleeve bore 38 and test plug 40 rotated with respect to retainer ring 18. Preferably, annular sealing test plug gasket 43 is provided between test plug face 42 and retainer ring 18.

Figure 6:
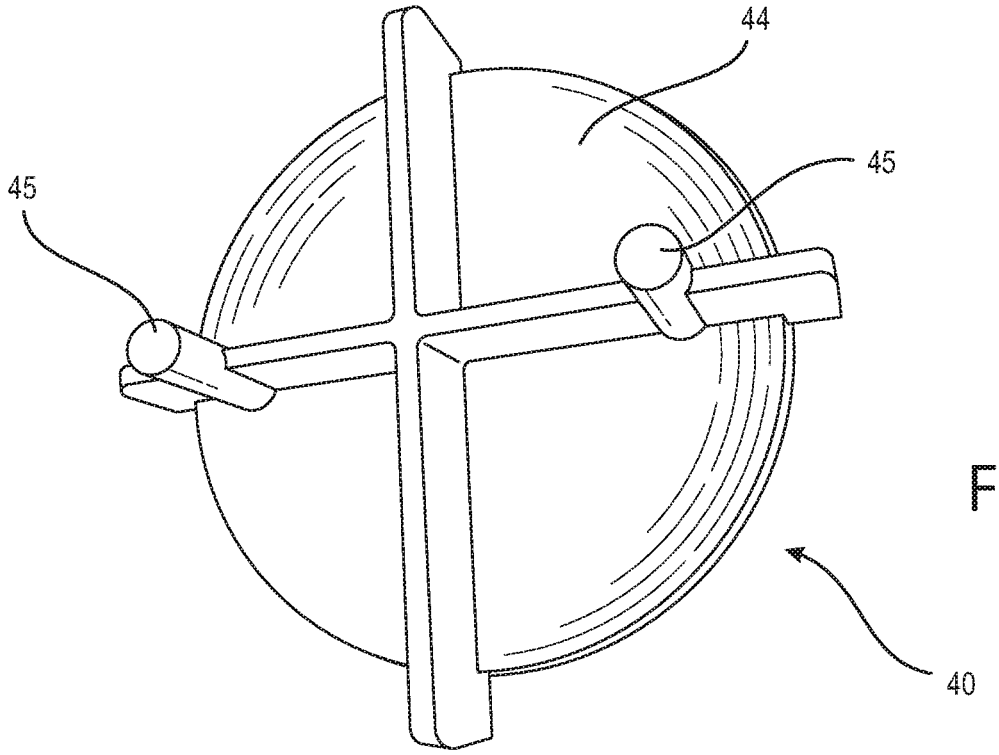
FIG. 6 is a perspective view of the opposite wrench face of the test plug of FIG. 5.

As best seen in FIGS. 4, 6 and 7, in a preferred embodiment of the invention test plug 40 has opposite wrench face 44 with posts 45. Post 45 are configured to be engageable with recesses 46 in retainer ring 18. In this embodiment of the invention, posts 45 are inserted into recesses 46 and test plug 40 used as a wrench to rotate the retainer ring 18 to drive threaded sleeve 21 over elbow cylinder 17 by the engagement sleeve threads 26 and cylinder threads 25.

Figure 8:
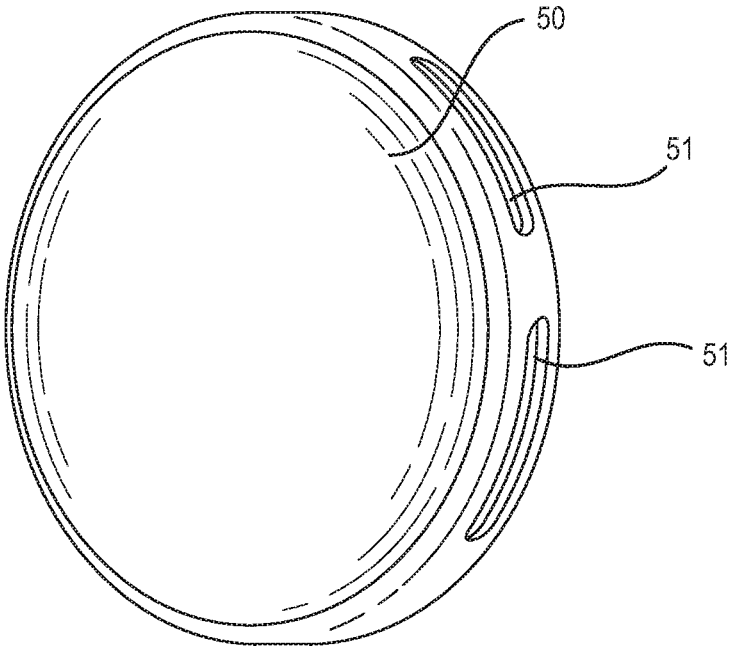
FIG. 8 is a perspective view of the retainer ring cover of the invention.
Figure 9:
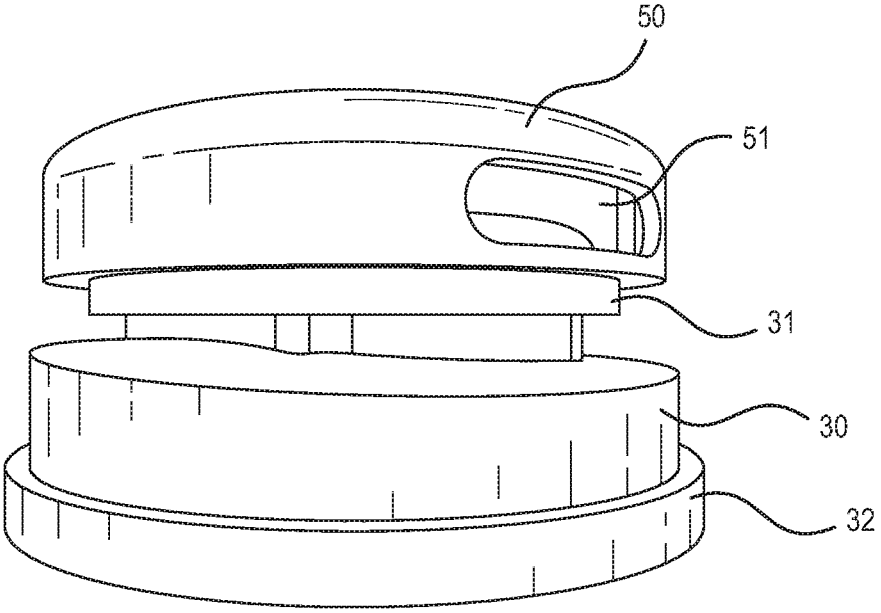
FIG. 9 is a side elevation view of the retainer ring cover mounted on the retainer ring of FIG. 4.

In another embodiment of the invention, as shown in FIGS. 8 to 9 retainer ring cover 50 is frictionally engageable to retainer ring 18 to provide overflow assembly 10 with a finished appearance. Retainer ring cover 50 has one or more cover flow port 51 to permit water from the bathtub to pass through retainer ring cover 50 and into ring flow paths 24.

What is claimed is:

1. A bathtub overflow assembly for interconnection with a bathtub having a circular overflow port of a fixed diameter in a wall of the bathtub, wherein the bathtub overflow port has a tub interior side and a tub exterior side, said overflow assembly comprising:

an overflow pipe having a pipe flange sized to circumscribe the overflow port on the tub exterior side;

the overflow pipe having an elbow portion axially behind the overflow flange and an externally threaded cylinder projecting axially from said elbow portion in the direction of the overflow flange;

an overflow retainer ring having a ring flange sized to circumscribe the overflow port on the tub interior side, said retainer ring having an internally threaded sleeve of a fixed diameter not greater than one half the diameter of the overflow port, said sleeve projecting axially from said retainer ring in the direction of said elbow and attached to said retainer ring by at least three vanes which are approximately equally spaced around said sleeve, said vanes extending radially from the sleeve to the ring flange, with said retainer ring, said sleeve and said vanes defining therebetween flow paths from the bathtub to the overflow pipe;

wherein the overflow pipe cylinder and the retainer ring sleeve are axially alignable and the threads on said overflow pipe cylinder and the threads on the retainer ring sleeve are engageable, and wherein when the overflow pipe is positioned at the bathtub overflow port on the tub exterior side and the retainer ring is positioned at the overflow port on the tub interior side and the retainer ring is rotated relative to the overflow pipe the threaded surfaces of the cylinder and the sleeve engage pulling the flanges of the overflow pipe and the retainer ring together on opposite sides of the overflow port; and wherein the retainer ring sleeve has an axially aligned internally threaded center bore and a removable test plug has a face sized and adapted to sealingly cover the retainer ring, and the test plug has an externally threaded axial projection cooperatively aligned and threadedly engageable with the threads of the sleeve bore and the test plug is pulled into engagement with the retainer ring when the test plug is rotated with respect to the retainer ring.

2. The bathtub overflow assembly of claim 1, wherein four vanes attach the sleeve to the retainer ring.

3. The bathtub overflow assembly of claim 2, wherein there are annular sealing gaskets between the overflow pipe flange and the tub exterior side and between the ring flange and the tub interior side.

4. The bathtub overflow assembly of claim 3, wherein the overflow pipe flange and the retainer ring flange have annular walls which at least partially circumscribe respectively the annular sealing gasket between the overflow pipe and the tub exterior side and the annular sealing gasket between the retainer ring and the tub interior side.

5. The bathtub overflow assembly of claim 4, wherein there is an annular sealing gasket between the test plug and the retainer ring.

6. The bathtub overflow assembly of claim 5, wherein the retainer ring has recesses, the test plug has a second face opposite to the face which seals to the retainer ring and said opposite face has posts engageable with the recesses in the retainer ring whereby the test plug can be used as a wrench to rotate the retainer ring.

7. The bathtub overflow assembly of claim 6, further comprising a retainer ring cover frictionally engageable to the retainer ring.

8. The bathtub overflow assembly of claim 7, wherein the retainer ring cover has one or more flow ports to admit water from a bathtub to pass to and through the retainer ring into the overflow pipe.

9. The bathtub overflow assembly of claim 1, wherein there are annular sealing gaskets between the overflow pipe flange and the tub exterior side and between the ring flange and the tub interior side.

10. The bathtub overflow assembly of claim 9, wherein the overflow pipe flange and the retainer ring flange have annular walls which at least partially circumscribe respectively the annular sealing gasket between the overflow pipe and the tub exterior side and the annular sealing gasket between the retainer ring and the tub interior side.

11. The bathtub overflow assembly of claim 1, wherein there is a sealing gasket between the test plug and the retainer ring.

12. The bathtub overflow assembly of claim 1, wherein the retainer ring has recesses, the test plug has a second face opposite to the face which seals to the retainer ring, and said opposite face has posts which are engageable with the recesses in the retainer ring whereby the test plug can be used as a wrench to rotate the retainer ring.

13. The bathtub overflow assembly of claim 1, further comprising a retainer ring cover frictionally engageable to the retainer ring.

14. The bathtub overflow assembly of claim 13, wherein the retainer ring cover has one or more flow ports to admit water from a bathtub to pass to and through the retainer ring into the overflow pipe.

* * * * *